US005722546A

United States Patent [19]

Briere

[11] Patent Number: 5,722,546

[45] Date of Patent: Mar. 3, 1998

[54] CHILD-RESISTANT CLOSURE AND CONTAINER

[75] Inventor: Marc Briere, Newburgh, Ind.

[73] Assignee: Rexam Closures Inc., Evansville, Ind.

[21] Appl. No.: 766,527

[22] Filed: Dec. 13, 1996

[51] Int. Cl.[6] ..... B65D 55/02

[52] U.S. Cl. ..... 215/216; 215/221

[58] Field of Search ..... 215/216, 217, 215/219, 221, 223, 330

[56] References Cited

U.S. PATENT DOCUMENTS 3,989,152 11/1976 Julian ..... 215/216
4,149,646 4/1979 Julian ..... 215/216
4,752,014 6/1988 House et al. ..... 215/216
5,462,182 10/1995 Opresco ..... 215/216
5,560,505 10/1996 Schneider et al. ..... 215/330
5,577,624 11/1996 Berta et al. ..... 215/221

*Primary Examiner*—Stephen Cronin
*Attorney, Agent, or Firm*—Gifford, Krass, Groh, Sprinkle, Patmore, Anderson & Citkowski, P.C.

[57] ABSTRACT

A child-resistant closure and container package having push tabs formed in the closure to prevent rotation relative to the container until the push tabs are deflected radially inwardly to disengage from lock members on the container to permit unthreading rotation of the closure relative to the container. Simultaneous squeezing of the push tabs and rotation of the closure permit removal of the closure from the container. Also, a tamper indicating feature is associated with the push tabs.

12 Claims, 2 Drawing Sheets

CHILD-RESISTANT CLOSURE AND CONTAINER

This invention relates to child-resistant closures and containers and more particularly to threaded closures which require squeezing to permit unthreading movement.

A variety of child-resistant closures have been provided in which deflection of the cylindrical wall or skirt of the closure deforms the skirt opening into an oval so that the lock elements on the skirt move radially outwardly to disengage from the complementary lock member on the container. Such squeeze and turn closures are popular and are widely used but have objectionable features or limitations. By way of example, the engagement and disengagement of the lock mechanism is dependent on the flexibility of the skirt of the closure so that careful control of the wall thicknesses is required. Also, it has been found that the amount of movement of the lock elements radially outwardly on the major axis of the oval is substantially less than the movement resulting from squeezing inwardly on the minor axis of the oval. In some instances the difference or loss of movement is as much as thirty percent. It is desirable to make more effective use of the squeezing movement so that an increment of squeezing movement will result in an equal increment of unlocking movement.

It is an object of the invention to provide a child-resistant package in which one of two action's required to open the package is a squeezing action on the skirt of the closure during which the squeezing force is applied substantially in line with the required movement to achieve disengagement of the locking mechanism preventing unthreading movement.

It is a further object of the invention to provide such a child-resistant package in which the squeezing movement and unlocking movement are substantially equal.

The purposes of the invention are achieved by a package in which the closure is formed with deflectable tabs in the skirt of the closure such that, in the undeflected condition of the tabs, lock members on the container are engaged to stop unthreading movement. Deflection of the tab or tabs, radially inwardly move the deflectable tabs out of the path of the lock member on the container to permit unthreading action of the closure and opening of the package. In one embodiment of the invention, the tab or tabs extend axially of the closure and are moveable relative to the skirt and to the lip at the bottom of the skirt. In another embodiment of the invention, the tabs are formed to terminate adjacent to the lip so that the lip remains continuous to reinforce the closure. Still another embodiment of the invention contemplates the addition of a tamper-indicating feature by which prior efforts to open the closure can be detected.

DETAILED DESCRIPTION

Figure 3:
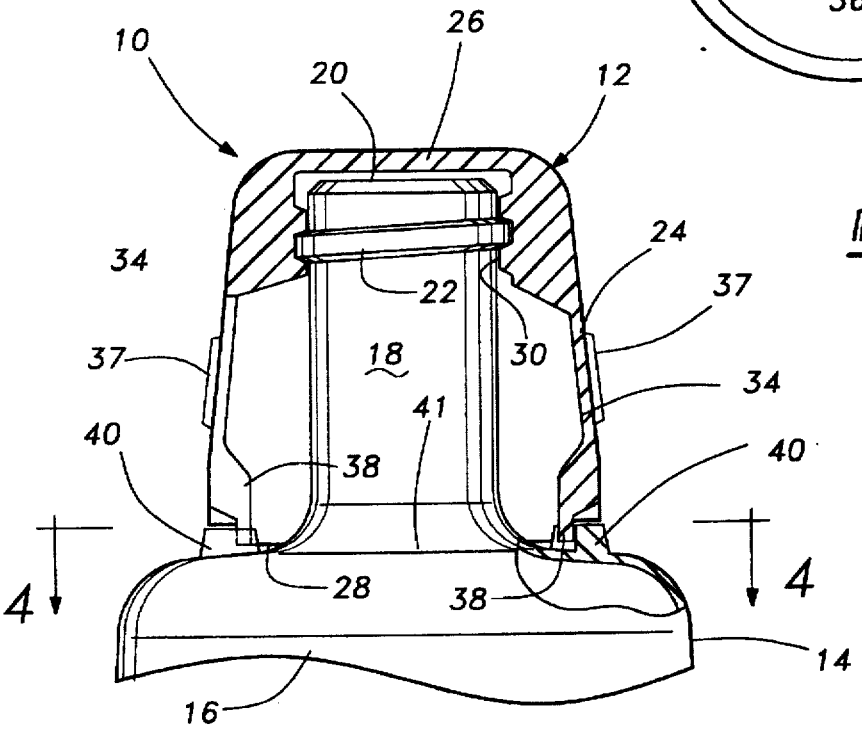
FIG. 3 is a cross-sectional view of the closure and container with the closure shown in cross-section taken on line 3—3 in FIG. 2.

Referring to the drawings and particularly to FIG. 3, the child-resistant closure and container package is referred to generally at 10 and includes a closure 12 and the container 14.

The container 14 has a body portion 16 for holding the contents of the container and a cylindrical neck 18 having a lip 20 surrounding an opening through which the contents of the container can be discharged. Closure receiving threads 22 are formed on the neck 18 adjacent to the lip 20.

Closure 12 has a cylindrical wall or skirt 24, the upper end of which is closed by a top wall 26. The lower end of the cylindrical wall 24 forms an opening defined by an annular lip 28 which receives the neck 18 of the container 14. Threads 30 complementary to the threads 22 on the neck 18 are formed adjacent to the top 26 of the closure 12.

In the closed condition of the package seen in FIG. 3, the threads 22 and 30 are engaged with each other to hold the closure 12 in a closed condition on the container. In that condition, the cylindrical wall 24 below the threads 30 is spaced from the outer wall of the neck 18.

Figure 1:
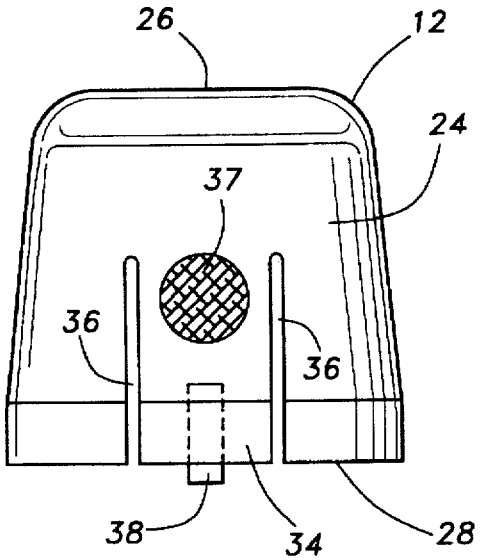
FIG. 1 is a elevation view of the closure forming part of the child-resistant closure and container package of the present invention.

Push tabs 34 are formed in the cylindrical wall 24 by axially extending, spaced slots 36 which begin below the closure threads 30 and extend through the lip 28. Push tabs 34 are deflectable relative to the remainder of the cylindrical wall or skirt 24. For that purpose, push tabs or pressure pads 37 are provided as indicated in FIG. 1 so that the application of finger pressure at this point will cause the lower end of the tab 34 to move radially inwardly toward the neck 18 and relative to the adjacent wall or skirt 24.

The lower ends of the push tabs 34 are provided with lock elements 38 which are located on the inner wall surface of tabs 34 and project axially below the lid 28. In the normally closed condition of the container, lock elements 38 engage lock members 40 molded integrally with the container body 16 on a shoulder adjacent to the neck 18.

Figure 4:
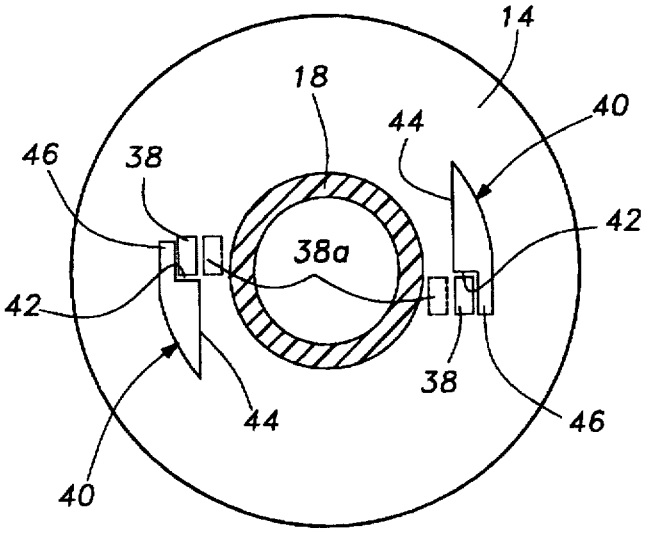
FIG. 4 is a cross-sectional view taken on line 4—4 in FIG. 3.

As best seen in FIG. 4, the lock elements are arranged in diametrically opposed relationship to each other and each includes a lock surface 42. The lock surfaces 42 are engaged by the lock elements 38 to prevent unthreading rotation of the closure 12 relative to the container 14. Upon pressing the pressure points 37 radially inwardly the tabs 34 together with the lock elements 38 swing radially inwardly to the unlocked position indicated at **38*a* in FIG. 4. While the tabs 34 are depressed simultaneously rotation or unthreading movement of the closure 12 is permitted and the closure can be completely removed from the container 14**.

Replacement of the closure 12 on the container 14 is facilitated by cam surfaces 44 formed on the lock members 40. The cam surfaces 44 are so positioned that in the normal undetected condition of the tabs 34 relative to the skirt 24, closing rotation of the closure 12 causes the lock elements 38 to come into engagement with the cam surfaces 44. Continued rotation causes the tabs 34 to be deflected radially inwardly together with the lock elements 38 so that the latter are guided to pass around the lock members 40 to permit the closure to reach a fully closed position on the container 14. Upon release of pressure from the tabs 34, the closure is in a locked condition.

The lock members 40 are each provided with a guard portion or walls 46 which extends circumferentially from the lock surface 32. The guard wall portions 46 are positioned radially outwardly and adjacent to the lock elements 38 when the closure is in a locked condition as shown in FIG. 4. The guard walls 46 act as stops to prevent radial outward deflection of the lock elements 38 and the associated push tabs 34. Such unlocking action could possibly be brought about by children using their teeth to pry the push tabs radially outwardly to permit subsequent unthreading of closure 12 from the container 14.

Figure 5:
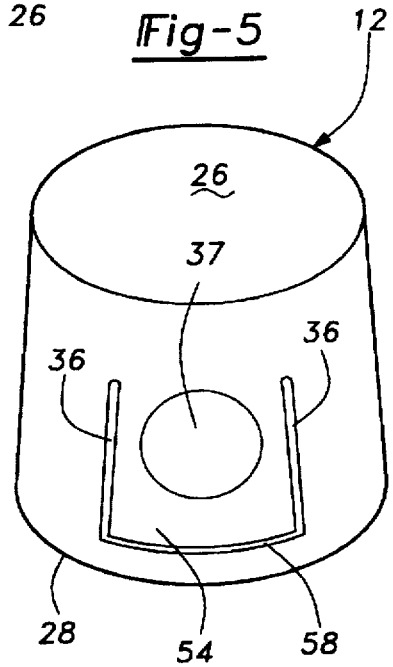
FIG. 5 is a perspective view of a second embodiment of the invention.
Figure 6:
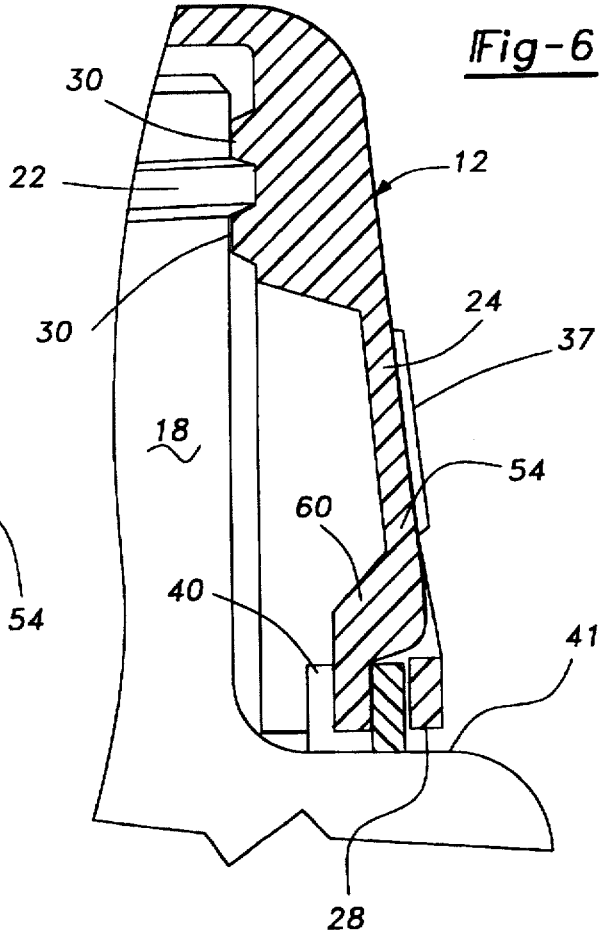
FIG. 6 is a cross-sectional view at an enlarged scale of the closure seen in FIG. 5 in association with the neck of a container with the closure shown in cross-section.

Another embodiment of the invention is shown in FIGS. 5 and 6. In this case push tabs 54 are formed by a pair of circumferentially spaced, axially extending slots 56 which terminate short of the lip 28 of the closure 12 and are joined by a circumferentially extending slot 58. This construction allows the lip 28 of the container 12 to remain continuous and uninterrupted to reinforce and maintain the circular shape of the closure 12.

Figure 2:
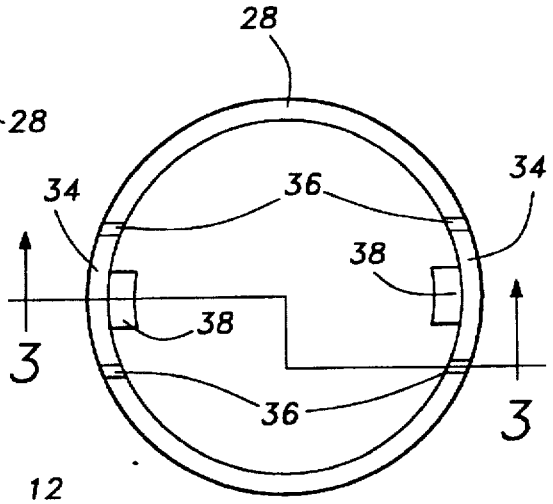
FIG. 2 is a bottom view of the closure seen in FIG. 1.

The inside surface of the push tab 54 are provided with lock elements 60. The lock elements 60 engage lock members 40 having the same general configuration as the lock member 40 shown in FIG. 4. Upon application of pressure to the pressure points 37, the push tabs 54 are deflected radially inwardly so that the lock elements 60 disengage from the lock members 40 and permit subsequent rotation of the closure 12 in an opening direction relative to the container 14 for removal from the neck 18. In this embodiment of the invention, the lip 28 of the closure 12 can be brought into closer proximity to the shoulder 41 of the container 14 than in the embodiment of FIGS. 1–3.

In both of the embodiments of the invention, opening movement requires a simultaneous squeezing of the closure and unthreading rotation of the closure relative to the container. The squeezing action is required to disengage the lock mechanism made up of the lock elements 38 and 60 from the lock members 40. This squeezing action is applied on the push tabs 34 or 54 in close proximity to the lock mechanism made up of the lock elements 38, 60 and the lock members 40. The application of force in this manner is effective to transform all squeezing movement into unlocking movement. This overcomes the limitation of squeeze and turn caps in which the deformation of the lip of the closure into an oval is required with an accompanying loss of unlocking movement.

Although in both embodiments of the invention reference has been made to diametrically opposed push tabs 34 and 54 and associated lock elements 40, it will be understood that a single push tab and associated lock element could be used and substantially the same type operation and benefits would result. In the preferred embodiments, the use of two push tabs is thought to be desirable because it requires the same familiar squeezing action at opposite points as conventional push and mm closures which are squeezed into an oval shape. Also, the requirement of squeezing at opposite points on the closure skirt is thought to increase the level of difficulty of opening by children.

Figure 7:
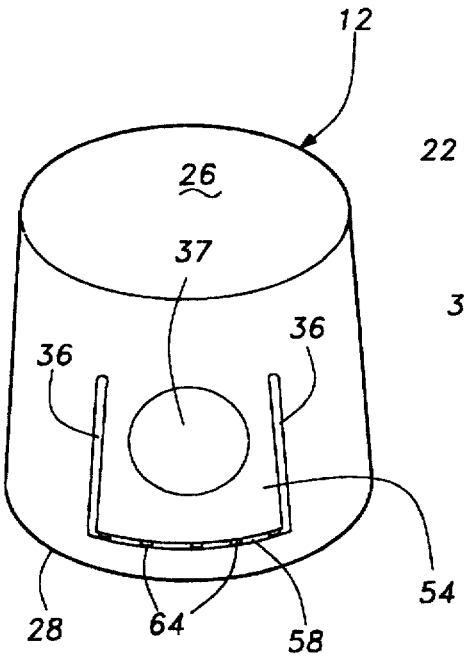
FIG. 7 is a perspective view similar to FIG. 5 of still another embodiment of the invention having tamper-indicating features.

Still another variation of the invention is shown in FIG. 7. The closure 12 is generally identical with the embodiment shown in FIG. 5 with the exception that webs 64 are formed in the slot 58. Opening of the package by deflection of the push tab 54 requires that the webs 64 be broken. The fracture of webs 64 serves to indicate that there has been an attempt to open the package. If desired, similar webs can be used in association with the slots 36 defining the push tabs 34 of the first embodiment of the invention. Also, the webs 64 can be replaced by a continuous membrane or other line of weakening which fractures upon the application of force to the pressure points 37. The fracture of the webs 64 or membranes serves as a tamper-indicating feature giving evidence of prior attempts to open the container.

It will be noted that the pressure points 37 for the lock tabs 34 and 54 are in close proximity to the lock elements 38 and 60. In this manner, the manual force required to unlock the closure is applied in close proximity to the lock elements which must be moved out of engagement with the lock members 40 to bring about complete opening movement.

It is contemplated that the push tabs 54 of the closure 12 can be thinner in cross-section than the adjoining skirt walls to provide for easier deflection of the push tabs 54 than of the remaining walls of the skirt.

A child-resistant closure and container package has been provided in which push tabs are arranged in the closure to prevent rotation of the closure relative to the container until the push tabs are deflected radially inwardly in order to disengage lock members on the container to permit continued unthreading action. Thus, simultaneous squeezing of the push tabs and rotation of the closure are required to accomplish opening of the container to accomplish child-resistant operation.

I claim:

1. A child-resistant closure and container package comprising:

a closure having a top and an annular skirt extending from said top to form an annular lip spaced axially from said top, a container having a cylindrical neck to be received in said closure complementary threads on said skirt and on said neck engageable to hold said closure on said container with said lip in radially spaced relation to said container, a push tab formed in said skirt below said threads to permit deflection of said tab radially inwardly relative to said neck and the adjacent portions of said skirt, said push tab being formed by axially extending, circumferentially spaced slots in said skirt and by a circumferentially extending slot in spaced adjacent relation to said lip and joining said spaced slots, a lock member on said container, and a lock element on said push tab engageable with said lock member to prevent unthreading of said closure from said container when said push tab is in its undetected position said tab being deflectable radially inwardly to move said lock element out of the path of said lock member to permit unthreading of said closure from said container.

2. The package of claim 1 and further comprising means preventing radial outward deflection of said push tab when said closure is in its closed position.

3. The package of claim 2 wherein said means preventing deflection of said tab is formed by said lock member.

4. The package of claim 1 and further comprising an additional lock member on said container in diametrically opposed relation to said first mentioned lock member.

5. The package of claim 4 and further comprising an additional push tab formed in said skirt in diametrically opposed relation to said first mentioned push tab.

6. The package of claim 1 and further comprising means for deflecting said lock element radially out of the path of said lock member during closing motion of said closure relative to said container.

7. The package of claim 6 wherein said means for deflecting is operative to deflect said tab radially inwardly.

8. The package of claim 1 wherein said lock member includes a portion preventing radial outward deflection when said closure is in a fully closed position on said container.

9. The package of claim 1 and further comprising tamper indicating means acting between said push tab and said skirt to be fractured upon depressing said tab for the first time after original closing of the container.

10. The package of claim 9 wherein said tamper indicating means are formed by webs of material closing said slots.

11. The package of claim 1 wherein said lock member is radially spaced from said cylindrical neck.

12. The package of claim 1 further comprising membrane means formed in said slots, said membrane means being broken upon initial deflection of said tab to an opening position to indicate prior unlocking.

* * * * *